US006503153B2

(12) United States Patent
Wang

(10) Patent No.: US 6,503,153 B2
(45) Date of Patent: Jan. 7, 2003

(54) GRIP TAPE HAVING MULTIPLE GRIPPING FUNCTIONS

(75) Inventor: Jack Wang, Taichung Hsien (TW)

(73) Assignee: High Cedar Enterprise Co., Ltd., Taichung (TW)

( * ) Notice: Subject to any disclaimer, the term of this patent is extended or adjusted under 35 U.S.C. 154(b) by 0 days.

(21) Appl. No.: 09/741,054

(22) Filed: Dec. 21, 2000

(65) Prior Publication Data

US 2002/0082109 A1 Jun. 27, 2002

(51) Int. Cl.[7] ..... A63B 53/14
(52) U.S. Cl. ..... 473/302; 473/523
(58) Field of Search ..... 473/300–303, 473/523, 549, 568

(56) References Cited

U.S. PATENT DOCUMENTS 1,441,986 A * 1/1923 Lard
1,556,781 A * 10/1925 Gjorup
2,166,044 A * 7/1939 Fletcher
2,200,626 A * 5/1940 Lamkin
4,613,537 A * 9/1986 Krupper
5,692,971 A * 12/1997 Williams
5,890,972 A * 4/1999 Huang

* cited by examiner

*Primary Examiner*—Stephen Blau
(74) *Attorney, Agent, or Firm*—Browdy and Neimark, P.L.L.C.

(57) ABSTRACT

A grip tape is formed of a tape body and an elastomer. The tape body has an inner surface and an outer surface. The elastomer is fastened to the inner surface of the tape body such that the elastomer is extended along the longitudinal direction of the tape body. The tape body is wound spirally on a handle to form a grip segment on the handle in such a manner that the elastomer is located in the grip segment, and that the length of the elastomer ranges between 30% and 70% of the total length of the grip segment.

16 Claims, 3 Drawing Sheets

GRIP TAPE HAVING MULTIPLE GRIPPING FUNCTIONS

FIELD OF THE INVENTION

The present invention relates generally to a grip tape, and more particularly to a grip tape having multiple gripping functions.

BACKGROUND OF THE INVENTION

The handle of the game racket is often provided with a conventional grip tape of a synthetic or natural leather. The conventional grip tape is provided in the surface with a plurality of pores, embossed structures, ground structures, or elastomers to enable the grip tape to absorb perspiration or shock, and to enhance the skidproof effect of the grip tape. The conventional grip tape has a uniform mechanical function in terms of perspiration absorption, friction coefficient, elasticity, shock-absorption, etc. The handles of the game rackets are intended to be held with one or two hands. The golf club is always held with both hands which are acted on differently at the time when a golf ball is hit by the golf club. In light of both hands holding different portions of the handle, both hands are different in the gripping requirements. The conventional grip tape is not provided with multiple gripping functions to meet the demand of a sophisticated user of the game racket or golf club.

SUMMARY OF THE INVENTION

The primary objective of the present invention is to provide a grip tape having multiple gripping functions.

The grip tape of the present invention comprises a tape body, and an elastomer which is disposed along the longitudinal direction of the inner surface of the tape body. The elastomer is smaller in length than the tape body. When the grip tape is wound spirally on a handle to form a grip portion on the handle, the elastomer amounts to 30%–70% of the total length of the grip portion.

DETAILED DESCRIPTION OF THE INVENTION

Figure 1:
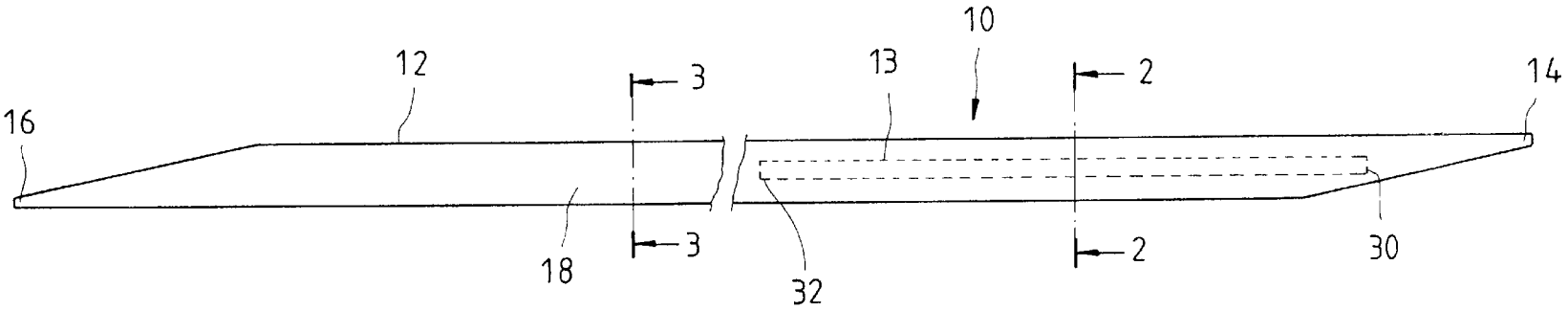
FIG. 1 shows a top view of a first preferred embodiment of the present invention.
Figure 3:
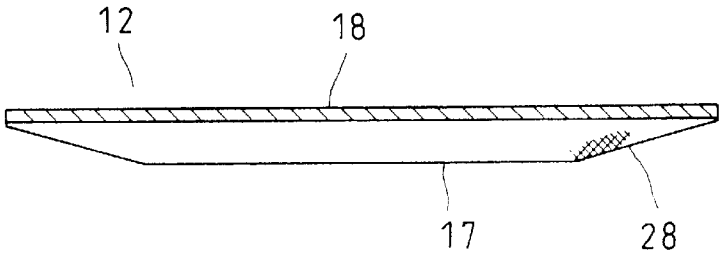
FIG. 3 shows a sectional view taken along the direction indicated by a line 3—3 as shown in FIG. 1.
Figure 2:
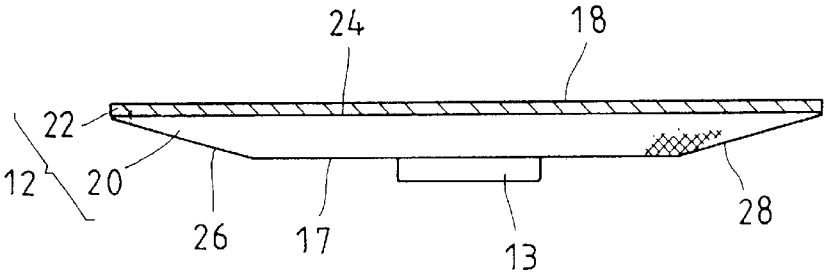
FIG. 2 shows a sectional view taken along the direction indicated by a line 2—2 as shown in FIG. 1.

As shown in FIGS. 1–3, a grip tape 10 embodied in the present invention comprises a tape body 12 and an elastomer 13.

The tape body 12 a head end 14, a tail end 16, an inner surface 17, and an outer surface 18. The tape body 12 is formed of a bottom layer 20 and a top layer 22. The bottom layer 20 is made of a nonwoven cloth having a number of intertwining fibers. The bottom layer 20 has the inner surface 17 and a top surface 24. The top layer 22 is formed by the top surface 24 which is coated with a mixture solution containing polyurethane and is then foamed, cured, and dried. The bottom layer 20 is provided in two side edges with an inclined portion 26, 28 extending along the longitudinal direction of the bottom layer 20.

The elastomer 13 is a long striplike body and is made of an artificial sponge, elastic plastic, or rubber material, such as polyvinyl chloride, ethylene vinyl acetate, etc. The elastomer 13 has a head end 30 and a tail end 32. The elastomer 13 has a length, which is a distance between the head end 30 and the tail end 32 and is smaller than that of the tape body 12. The elastomer 13 of the first preferred embodiment of the present invention has a length which is about equal to 50% of the length of the tape body 12. The elastomer 13 is smaller in width than the tape body 12. The elastomer 13 is attached by an adhesive (not shown in the drawings) to the central portion of the inner surface 17 of the tape body 12 such that the head end 30 of the elastomer 13 is contiguous to the head end 14 of the tape body 12, and that the elastomer 13 is extended along the longitudinal direction of the tape body 12.

Figure 4:
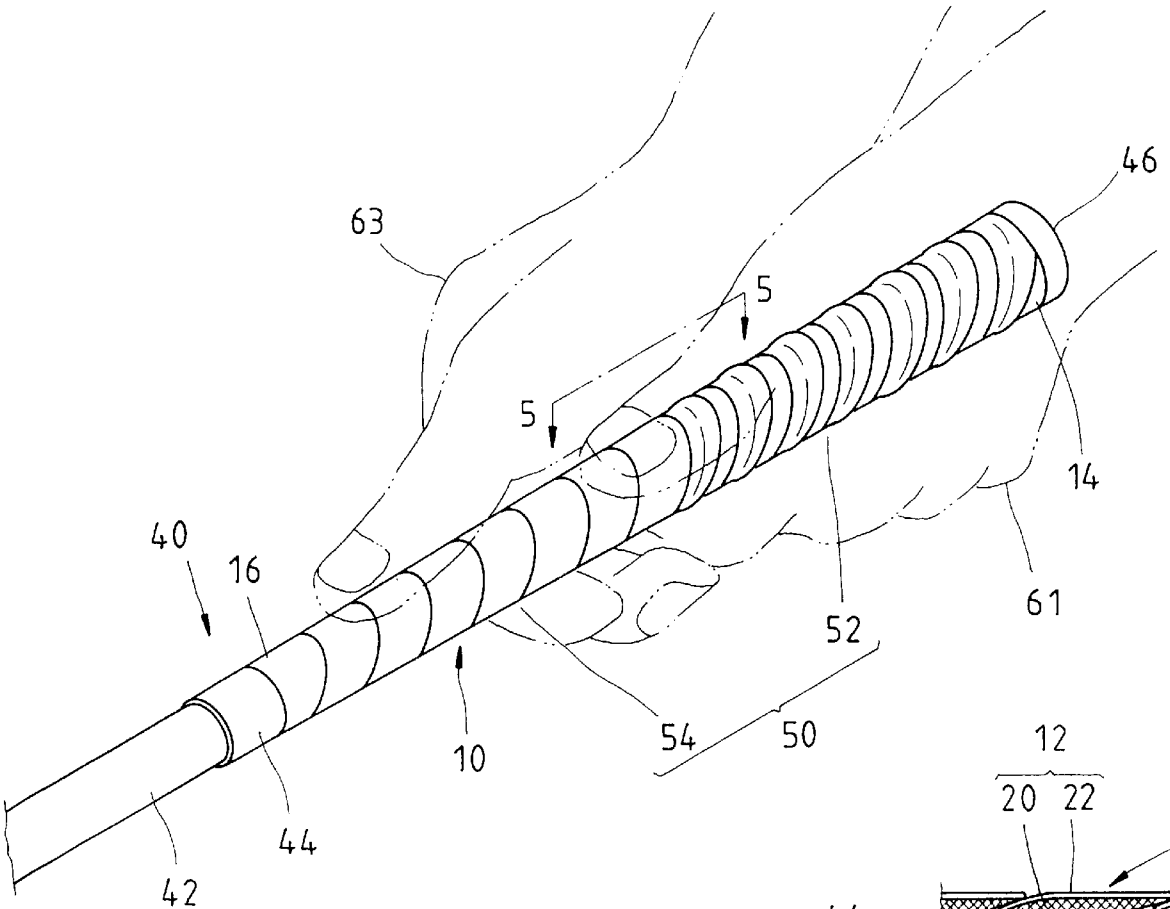
FIG. 4 shows a schematic view of the first preferred embodiment of the present invention being wound on a golf club.
Figure 5:
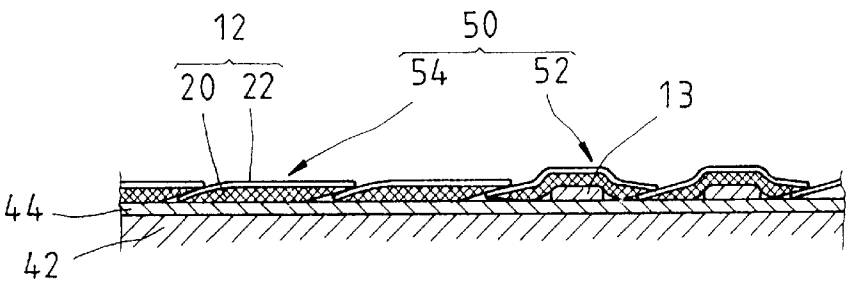
FIG. 5 shows a sectional view taken along the direction indicated by a line 5—5 as shown in FIG. 4.

As shown in FIGS. 4 and 5, the grip tape 10 of the present invention is wound on a golf club handle 40 which is a rubber sleeve 44 fitted over the golf club shaft 42. The golf club handle 40 has a free end 46. The grip tape 10 is wound in such a manner that the head end 14 of the tape body 12 of the grip tape 10 is contiguous to the free end 46 of the golf club handle 40, and that the grip tape 10 is then wound spirally on the golf club handle 40. The tail end 16 of the tape body 12 of the grip tape 10 is attached to the golf club handle 40 by an adhesive tape (not shown in the drawings). As a result, a grip segment 50 of a predetermined length is formed on the golf club handle 40. The grip segment 50 is divided into a first section 52 and a second section 54, with the first section 52 being located in proximity of the free end 46 of the golf club handle 40. The elastomer 13 is located in the first section 52 which has a corrugated profile. The second section 54 is flat and devoid of the elastomer 13.

For a right-handed golfer, his or her left hand 61 holds the first section 52, which provides a major force for hitting the golf ball. Upon hitting the golf ball, the shock wave is absorbed by the elastomer 13 which is located in the first section 52. In addition, the elastomer 13 has a skidproof effect enabling the left hand 61 to grip firmly the golf club. In the meantime, the golfer's right hand 63 holds the second section 54 for guiding the ball-hitting direction. The grip tape 10 of the present invention is readily provided with the multiple gripping functions to meet the needs of the left hand and the right hand of a golfer.

In must be noted here that the grip tape 10 of the present invention may be directly wound on the golf club shaft 42 instead of the rubber sleeve 44. In light of the golfers being different in palm size, the length of the first section 52 or elastomer 13 should be at least greater or equal to 30% of the total length of the grip segment 50. Preferably, the length of the first section 52 or elastomer 13 is smaller or equal to 70% or so of the total length of the grip segment 50.

Figure 6:
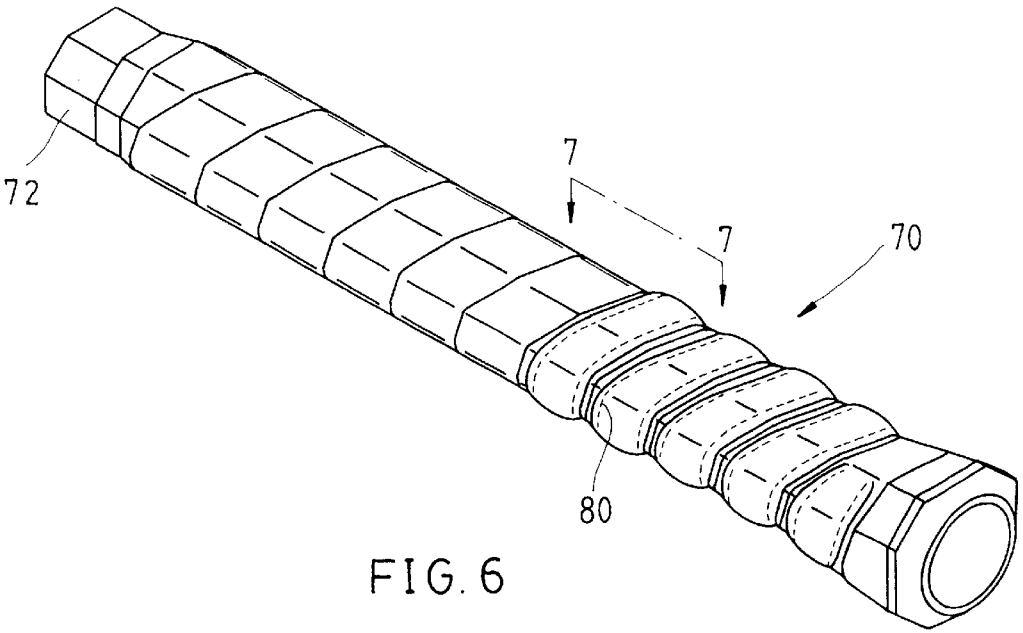
FIG. 6 shows a schematic view of a second preferred embodiment of the present invention being wound on a tennis racket handle.
Figure 7:
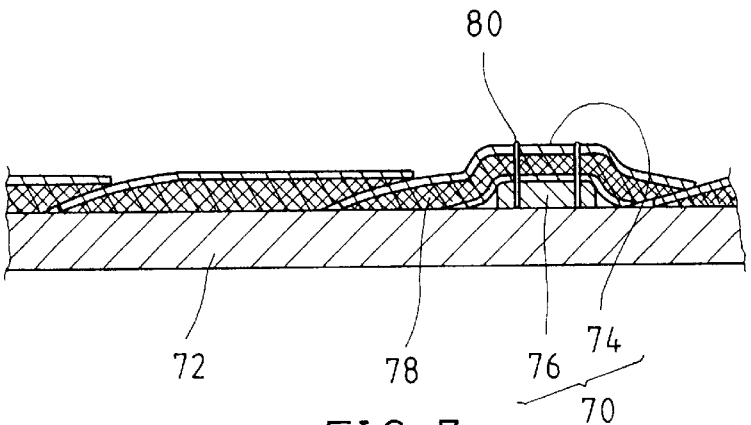
FIG. 7 shows a sectional view taken along the direction indicated by a line 7—7 as shown in FIG. 6.

Now referring to FIGS. 6 and 7, a grip tape 70 of the second preferred embodiment of the present invention is shown being wound on a tennis racket handle 72. The grip tape 70 comprises a tape body 74 and an elastomer 76.

The grip tape 70 is basically similar in construction of the grip tape 10 described above, except that the tape body 74 of the grip tape 70 is made of a woven or nonwoven cloth 78, which is first impregnated with a mixture solution containing polyurethane and is then foamed, cured, and dried. The cloth 78 serves to reinforce the structural strength of the tape body 74. In addition, the tape body 74 and the elastomer 76 are joined together by sewing in conjunction with a thread 80, so as to stabilize the corrugated profile.

The tape bodies 12 and 74 of the present invention are made of a synthetic leather of a composite material. However, the tape bodies 12 and 74 may be made of a natural leather, or polymer material such as polyvinyl chloride, ethylene vinyl acetate, or polyurethane.

What is claimed is:

1. A grip tape for use on a handle of a ball hitting device, comprising:

a tape body having an inner surface and an outer surface, the inner surface having a width smaller than that of the outer surface so that longitudinal edges of the tape body incline outward from the inner surface to the outer surface; and a single longitudinal elastomer strip fastened to a centerline of the inner surface to extend along the longitudinal direction of the tape body, the elastomer strip being smaller in length than that of the tape body and having a uniform depth;

wherein the tape body is less elastomeric than the elastomer strip; and wherein when the inner surface of the tape body is spirally wound on the handle to form a grip segment, a distance between ends of the elastomer strip range between 30% and 70% of a total length of the grip segment.

2. The grip tape as defined in claim 1, wherein said tape body is formed of a polyurethane foam body, and a cloth enclosed in said polyurethane foam body.

3. The grip tape as defined in claim 1, wherein said tape body is made of polyvinyl chloride, ethylene vinyl acetate, or polyurethane.

4. The grip tape as defined in claim 1, wherein said tape body is greater in width than said elastomer strip.

5. The grip tape as defined in claim 1, wherein said elastomer strip is fastened to said tape body by an adhesive.

6. The grip tape as defined in claim 1, wherein said elastomer strip is made of an artificial sponge.

7. The grip tape as defined in claim 1, wherein said tape body is formed of a nonwoven cloth having an inner surface and a top surface, and a polyurethane layer attached to said top surface of said nonwoven cloth such that said polyurethane layer forms an outer surface of said tape body.

8. The grip tape as defined in claim 1, wherein said tape body is made of a natural leather.

9. The grip tape as defined in claim 1, wherein said elastomer is fastened to said tape body by sewing.

10. A ball-hitting device comprising:

a handle having a free end; and a grip tape comprising:

a tape body having an inner surface and an outer surface, the inner surface having a width smaller than that of the outer surface so that longitudinal edges of the tape body incline outward from the inner surface to the outer surface; and a single longitudinal elastomer strip fastened to a centerline of the inner surface to extend along the longitudinal direction of the tape body, the elastomer strip being smaller in length than that of the tape body and having a uniform depth;

the grip tape wound on said handle to form a grip segment which is divided into a first section and a second section, said first section being greater or equal in length to 30% of a total length of said grip segment, and said first section being smaller or equal in length to 70% of the total length of said grip segment; wherein the shock absorbing ability of the first section is greater than said second section.

11. The ball-hitting device as defined in claim 10, wherein said tape body has a head end and a tail end; and wherein said elastomer strip has a head end and a tail end, and is fastened to said inner surface of said tape body such that said head end of said elastomer strip is contiguous to said head end of said tape body.

12. The ball-hitting device as defined in claim 11, wherein said elastomer strip is smaller in width than said tape body, thereby resulting in formation of a corrugated profile on said first section.

13. The ball-hitting device as defined in claim 12, wherein said elastomer is fastened to said tape body by sewing.

14. The ball-hitting device as defined in claim 10, wherein said tape body is formed of a polyurethane foam body, and a nonwoven cloth enclosed in said polyurethane foam body; and wherein said elastomer is formed of an artificial sponge;

wherein the tape body is less elastomeric than the elastomer strip.

15. The ball-hitting device as defined in claim 10, wherein said handle is a sleeve fitted over a golf club shaft.

16. The ball-hitting device as defined in claim 10, wherein said tape body is formed of a nonwoven cloth having an inner surface and a top surface, and a polyurethane layer attached to said top surface of said nonwoven cloth such that said polyurethane layer forms an outer surface of said tape body; wherein said elastomer is formed of an artificial sponge.

* * * * *